US009334706B2

(12) United States Patent
Phillips

(10) Patent No.: US 9,334,706 B2
(45) Date of Patent: May 10, 2016

(54) TOP DRIVE PIPE SPINNER

(71) Applicant: C. Allen Phillips, Rising Star, TX (US)

(72) Inventor: C. Allen Phillips, Rising Star, TX (US)

( * ) Notice: Subject to any disclaimer, the term of this patent is extended or adjusted under 35 U.S.C. 154(b) by 354 days.

(21) Appl. No.: 14/155,527

(22) Filed: Jan. 15, 2014

(65) Prior Publication Data

US 2015/0198002 A1 Jul. 16, 2015

(51) Int. Cl.

| | |
|---|---|
| ***E21B 19/00*** | (2006.01) |
| ***E21B 33/04*** | (2006.01) |
| ***E21B 19/10*** | (2006.01) |
| ***E21B 19/16*** | (2006.01) |
| ***E21B 19/07*** | (2006.01) |
| ***E21B 31/18*** | (2006.01) |

(52) U.S. Cl.

CPC ..... *E21B 33/0422* (2013.01); *E21B 19/07* (2013.01); *E21B 19/10* (2013.01); *E21B 19/161* (2013.01); *E21B 31/18* (2013.01)

(58) Field of Classification Search

CPC ..... E21B 19/07; E21B 19/10; E21B 19/161
See application file for complete search history.

(56) References Cited

U.S. PATENT DOCUMENTS

| | | | | | |
|---|---|---|---|---|---|
| 196,788 | A * | 11/1877 | Cummings | E21B 19/10 | 173/37 |
| 5,566,769 | A * | 10/1996 | Stuart | E21B 3/04 | 173/149 |
| 6,309,002 | B1 * | 10/2001 | Bouligny | E21B 19/07 | 294/86.15 |
| 7,669,662 | B2 * | 3/2010 | Pietras | E21B 19/06 | 166/380 |
| 8,042,626 | B2 * | 10/2011 | Slack | E21B 19/06 | 166/77.53 |
| 2011/0260480 | A1 * | 10/2011 | Scheider | E21B 19/07 | 294/102.2 |

FOREIGN PATENT DOCUMENTS

| | | | | |
|---|---|---|---|---|
| SE | WO 2015163813 A1 * | 10/2015 | ..... | E21B 19/10 |

* cited by examiner

*Primary Examiner* — John Krek
(74) *Attorney, Agent, or Firm* — Megan Lyman

(57) ABSTRACT

The present invention relates generally to a Top Drive Pipe Spinner (TDPS). The TDPS is a tool that allows for the setting of casing without a specialized crew or any additional power source. By employing the weight of the existing top drive to set slips on the casing collar, the TDPS allows one casing to be threaded onto the next in a timely and efficient manner. The casing tongs of the TDPS use passive release weight to release the casing collar from the casing to allow for the successive insertion of another casing section. The top drive spins the TDPS and compresses the unit onto the casing, then lifts the unit and releases the casing when desired.

14 Claims, 5 Drawing Sheets

TOP DRIVE PIPE SPINNER

FIELD OF INVENTION

The present invention relates generally to a Top Drive Pipe Spinner (TDPS). The TDPS is a tool that allows for the setting of casing without a specialized crew or any additional power source. By employing the weight of the existing top drive to set slips on the casing collar, the TDPS allows one casing to be threaded onto the next in a timely and efficient manner. The casing tongs of the TDPS use passive release weight to release the casing collar from the casing to allow for the successive insertion of another casing section. The top drive spins the TDPS and compresses the unit onto the casing, then lifts the unit and releases the casing when desired.

BACKGROUND

The use of a top drive technology has led to substantial improvements in efficiency and safety in drilling over the past 15 to 20 years. By contrast, methods for running casing, even with top-drive technology, have remained relatively unchanged. Traditional methods of running casing require the use of a special teams employed solely for the purposes of running casing, at significant cost to the driller. Additionally, these teams must be brought in, thus slowing the drilling process.

Power tongs are an established method to run casing in coordination with the drilling rig hoisting system. The power tong method allows the pipe segments to be mated with threaded ends between sequential segments as they are added to the string being installed in the well bore (or removed and disassembled). The power tong method, however, does not support other beneficial functions such as allowing the casing to be filled while moving the pipe. Previous methods and equipment do not include a tool that can run casing while serving other beneficial and time saving functions. For example, filling the pipe with fluid and the tool doubling use as a circulating tool to replace the fill tube when desired.

With top-drive technology coming into the drilling arena, drilling rigs equipped with top drives have enabled new methods of running casing and other tubulars. The top drive can be equipped with known running tools to grip and seal between the proximal pipe segment and the top drive quill (wherein quill is meant to include drive string components that may be attached, the distal end effectively acting as an extension of the quill).

Various devices have been developed to accomplish top-drive running casing. These devices are used in coordination with the top drive and allow rotating, pushing, and filling of the casing string with drilling fluid while running, thus removing the limitations of the power tong method. Simultaneously, automation of the gripping mechanism combined with the inherent advantages of the top drive reduces the necessity of a specialized team of skilled personnel who are being compensated for hard labor in sometimes hazardous conditions. These devices, with their independent operation without associated personnel, allow for increased safety and efficiency.

To handle and run casing with these top drive tubular running tools, the string weight is transferred from the top drive to a support device when the proximal or active pipe segments are being added or removed from the otherwise assembled string. This function is typically provided by an "annular wedge grip" axial load activated gripping device that uses "slips" or jaws placed in a hollow "slip bowl" through which the casing is run, where the slip bowl has a frusto-conical bore with downward decreasing diameter and is supported in or on the rig floor. The slips then acting as annular wedges between the pipe segment and the proximal end of the string and fusto-conical interior surface of the slip bowl, tractionally grip the pipe but slide or slip downward and thus radially inward on the interior surface of the slip bowl as string weight is transferred to the grip. The radial force between the slips and pipe body is thus axial load and self-activated or "self-energized", i.e., considering the tractional capacity the dependent and string weight the independent variable, a positive feedback loop exists where the independent variable of string weight is positively fed back to control the radial grip force with conotonically acts to control tractional capacity or resistance to sliding, the dependent variable.

Similarly, the torque applied to the active pipe segment must also be reacted out of the proximal end of the assembled string. This function is typically provided by tongs which have grips that engage the proximal pipe segment and an arm attached by a link such as a chain or cable to the rig structure to prevent rotation and thereby react torque not otherwise reacted by the slips in the slip bowl. The grip force of such tongs is similarly typically self-activated or "self-energized" by positive feedback from the applied torque load.

Multiple documents describe tools that can be used to run casing with the use of a top drive. For instance, U.S. Pat. No. 8,042,626 describes such a tool for use with a top drive that allows for rapid engagement, release, hoisting, pushing and rotating. The casing is engaged within the tool through rotation that is assisted by hydraulics.

However, no tool has been shown to work with the top drive, which is simple, requires no outside energy source, and maintains the integrity of the casing. Thus, there is a need for a casing tool that employs the top drive and is easily used, removing the need for personnel to run casing. A self-activated tool would be particularly advantageous; requiring no outside energy source for its proper function.

SUMMARY OF THE PRESENT INVENTION

The present invention is a top drive pipe spinner (TDPS) that substantially obviates the needs or problems due to the limitations and disadvantages of the related art.

Additional features and advantages of the invention will be set forth in the description which follows, and in part will be apparent from the description, or may be learned by practice of the invention. The objectives and other advantages of the invention will be realized and attained by the structural properties particularly pointed out in the written description and claims, as well as the appended drawings.

To achieve these and other advantages and in accordance with the purpose of the invention, as embodied and broadly described herein, the TDPS includes a top drive connection, bolts, turning sub with inverted taper, inverted slips, release weight, and a fill tube with fluid release valve.

The present invention grips casing from its exterior, thus preventing detrimental damage to the casing. Tools that grip from the interior can make marks on the casing and where the operator needs to swab the fluid out of the casing, the imperfections of markings on the interior of the casing can deteriorate the rubber swab cup.

Moreover, the present invention requires no outside energy for proper functioning by using the existing top drive and turning sub. The present invention requires little maintenance and can be used efficiently for long periods of time.

The TDPS of the present invention is a durable and resilient tool. The tool may be used for many years without substantial maintenance or repair. The TDPS of the present invention may be used for up to 9 years without repair. Thus, the TDPS of the present invention offers many advantages over the prior art.

It is to be understood that both the foregoing general description and the following detailed description are exemplary and explanatory only and are not restrictive of the invention, as claimed.

The accompanying drawings, which are incorporated in and constitute part of this specification, illustrate embodiments of the invention and together with the description, serve to explain the principles of the invention.

DETAILED DESCRIPTION OF THE PREFERRED EMBODIMENT

Figure 1:
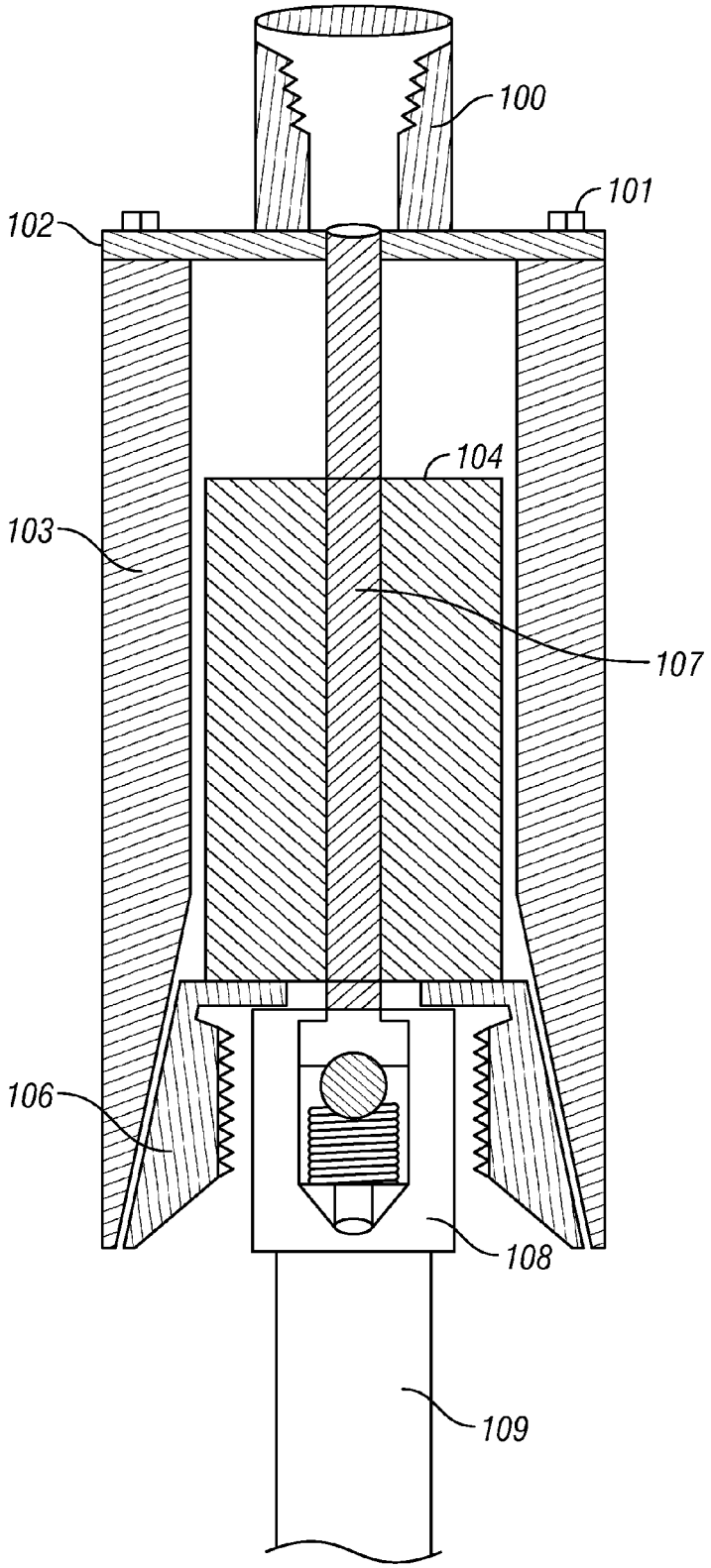
FIG. 1 is a cross section of one embodiment of the TDPS, with the slips disengaged of the present invention.

Reference will now be made in detail to the present preferred embodiments of the invention, examples of which are illustrated in the accompanying drawings. Wherever possible, the same reference characters will be used throughout the drawings to refer to the same or like parts.

FIG. 1 shows a cross section view of the TDPS of the present invention with the top drive connection 100 at the top of the TDPS. This connection 100 mates with an existing top drive to secure the TDPS in place. In one preferred embodiment of the present invention, the top drive connection 100 is threaded into the top head drive. Other methods of securing the top drive connection 100 to the top head drive are contemplated. In the preferred embodiment, the top drive connection 100 is about 8 inches long and 6 inches in diameter. The top drive connection 100 extends just through the top plate 102 and can be connected to the top plate 102 by welding. In the preferred embodiment the top drive connection 100 and top drive plate 102 can be made as one piece in manufacturing, lending to the durability and integrity of the TDPS of the present invention. As is known to those skilled in the art, other methods of securing the top drive connection 100 to the top plate 102 could be used, such as welding, and the like.

The top plate 102 connects the top drive connection 100 to the turning sub 103 and fill tube with fluid release valve 107. The top plate 102 is secured to the turning sub 103 by a plurality of bolts 101 on the upper surface of the top plate 102 (as is illustrated more particularly in FIG. 3). In one preferred embodiment, the top plate is approximately 1 inch in thickness. Other methods of securing the top plate 102 to the turning sub 103 are contemplated such as screws or other fasteners such as clamps that provide secure and removable fastening. and other known fastening means. Where the drive connection 100 and top plate 102 are one piece as described above, the top plate is removable from the turning sub 103, thus allowing access to the slips 106 and release weight 104.

In the preferred embodiment, the turning sub is 12 inches OD, and 8 inches ID. Moreover, the turning sub is approximately 2 feet long. The bottom half of interior of the turning sub is an inverted bevel. In one preferred embodiment, the inverted bevel is approximately 8 inches long. The bevel is approximately 11¾ inches inside diameter at its bottom most point, and 8 inches inside diameter with the wall thickness being approximately 2 inches thick at the topmost point (at the midsection of the turning sub), and approximately ⅛ inch thick at the bottom most point (at the end of the turning sub). Thus, the angle of the inverted bevel is approximately 15°. In the preferred embodiment, the turning sub extends approximately 3 inches below the bevel. In other embodiments, the angle of the bevel may be lower or higher, such as 10°, 20°, or 25°. As is known by those in the art, changing the bevel to a steeper degree (i.e., 25°) may be accomplished by shortening of the length of the bevel. In such an instance the O.D. at the top and the bottom of the bevel would be the measurements above, and the slips would have a shorter distance to travel. The preferred embodiment described above, at a 15° degree angle, will accommodate casing collars from 4½ inches to 6 inches. However, other embodiments that accommodate 6½ to 8⅝ inches, or 10 inches to 13 inches are contemplated by the present invention. Those embodiments require the scaling up of the dimensions herein provided.

Figure 2:
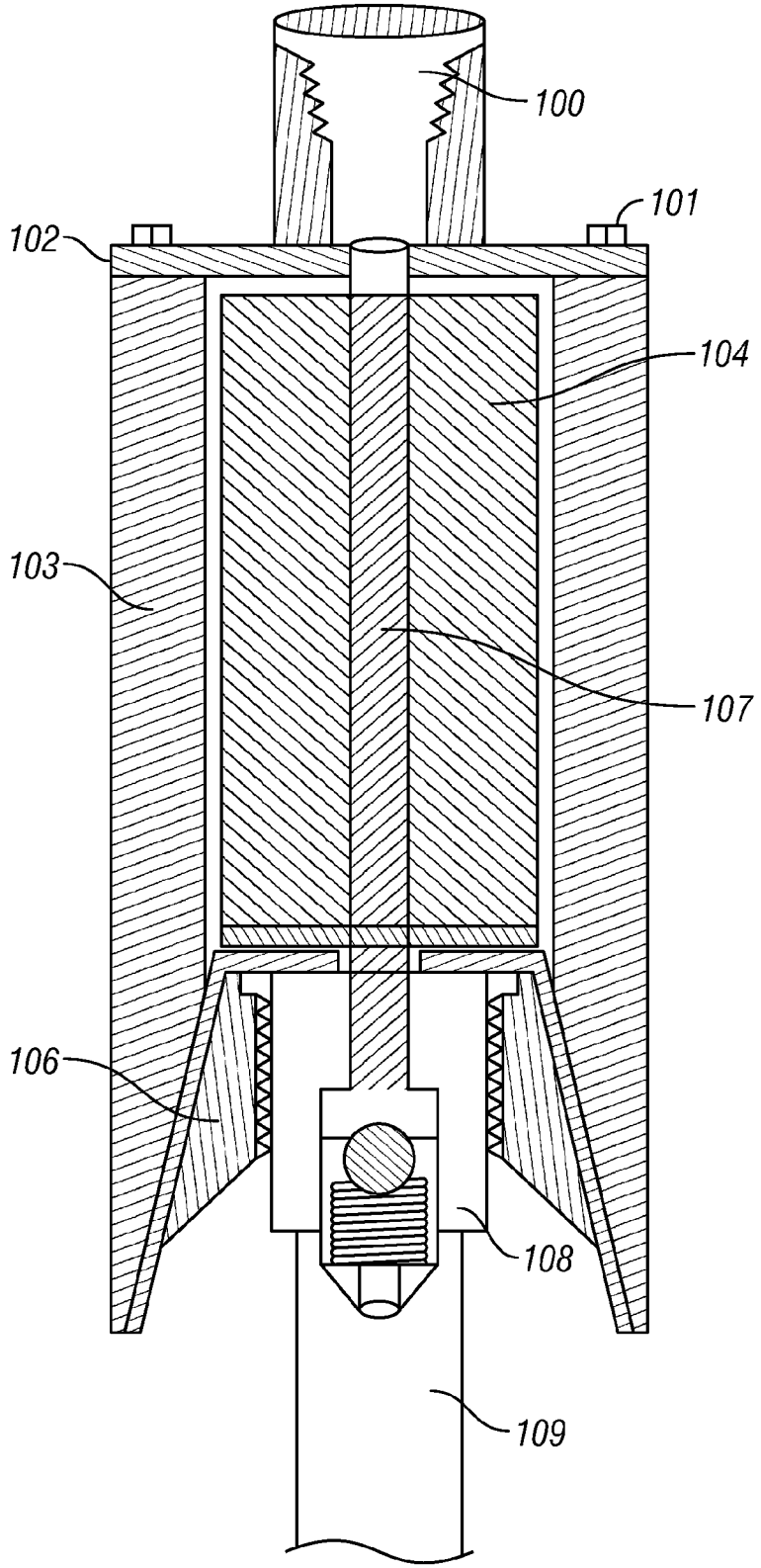
FIG. 2 is a cross section of one embodiment of the TDPS, with the slips engaged of the present invention.

As shown in FIGS. 1 and 2 the top plate 102 connects to the turning sub/spinner body 103. In one preferred embodiment, the spinner body 103 is approximately 8 inches ID 12 inches OD and 24 inches in length.

As shown further in FIG. 1, a release weight 104 assists the tool in properly aligning and securing the casing to the TDPS of the present invention. The release weight 104 sits on top of the slip segments to assist in releasing slip segments from casing after completion of attaching one segment of casing to another. The release weight 104 also assists in allowing the slip segments 106 to move synchronously to one another. Moreover, the release weight 104 is capable of movement upward and downward to efficiently allow casing to be secured within the TDPS. As seen in FIG. 1, the release weight 104 is in a downward position when the slips are disengaged, there being space between the top plate 102 and the release weight 104. When the release weight 104 is in the downward position, approximately 6 inches of space exist between the top of the release weight 104 and the top plate 102.

Figure 6:
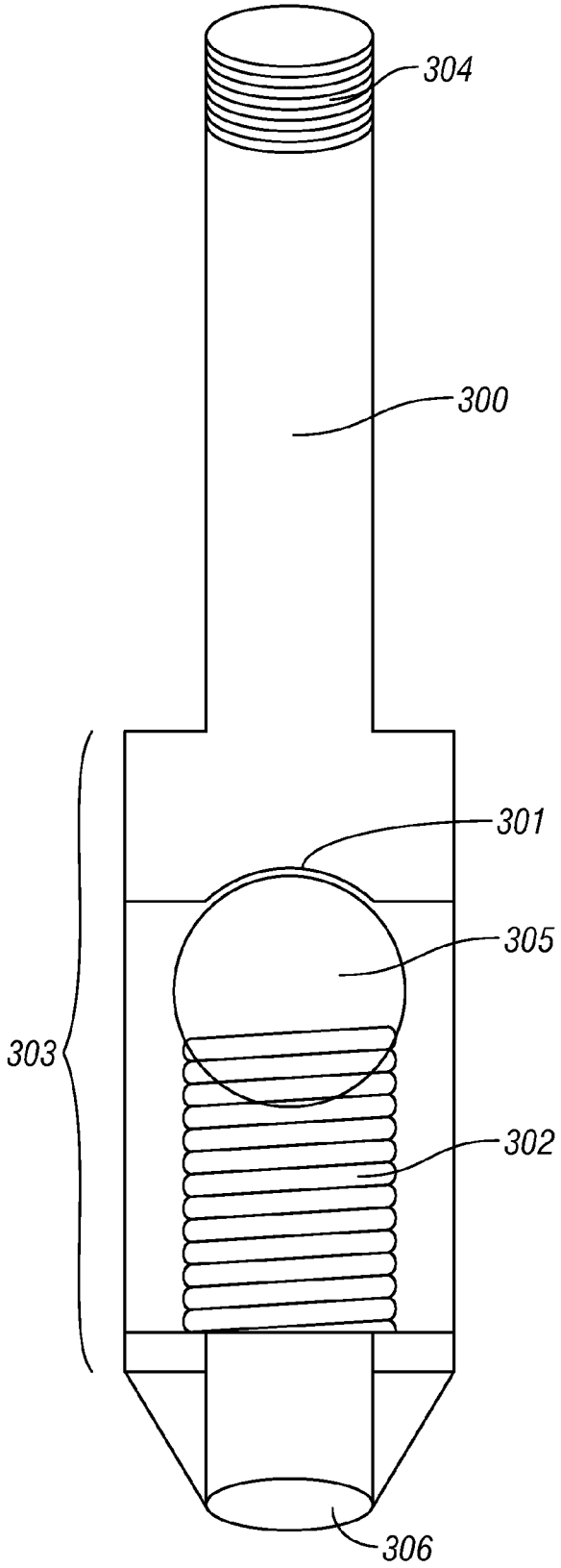
FIG. 6 is a cross section view of the fill tube and fluid release valve of the TDPS, as in an embodiment of the present invention.

The fill tube and fluid release valve 107 shown in FIGS. 1 and 2 and detailed in FIG. 6, allows the filling of casing/pipe while running each joint eliminating the need to stop and fill casing after a certain amount of pipe is ran. Having to stop and fill pipe periodically takes several hours when pipe is ran thousands of feet deep. Filling pipe with fill tube as each joint of pipe is ran saves valuable time and money since laid pipe will be full of fluid when the bottom is reached allowing operations to proceed. Filling as the pipe is run also eliminates air within the pipe, which is disadvantageous and inefficient. Details of the fill tube fluid release valve 107 are described below.

As shown in FIG. 1 the bottom of the release weight 104 secures the plurality of inverted slips 106 in the TDPS of the present invention. The release weight 104 is in the top twelve inches of pipe below the top drive connection 100. The release weight 104 sits on the slip segments 106, thus securing the slips 106 and preventing from hanging and moving in position. The details of the inverted slips 106 are further illustrated in FIG. 5 and described below. When the slips are disengaged position as illustrated in FIG. 1, the release weight 104 is in the downward position and the slip segments 106 are not in contact with the casing collar 108. The casing collar 108 has not yet been secured by the slip segments, and the fill tube and pressure release valve have not extended into the casing 109.

The inverted slips 106 as shown in FIG. 1 grip the casing collar 108 from its exterior, as shown in FIG. 2 when the slips are engaged. The casing collar 108 being connected to the casing 109 to be run. That casing 109 being placed through a rotary table at its opposite end to be threaded to a separate casing located below the ground and within the rotary table, once engaged as shown in FIG. 2.

In practice, the top head drive connection 100 is threaded to the existing top head drive. The casing 109, containing the casing collar 108 are moved to be received by the TDPS. The casing collar 108 is received by the inverted slips 106 of the TDPS after. As the casing 109 and collar 108 become substantially vertical, the top head drive (not shown) moves downward providing the weight to engage slip segments 106, providing enough downward pressure to cause slip segments 106 to grip the exterior of the casing collar 108 and engage the slips 106 as illustrated in FIG. 2.

The release weight 104 keeps slip segments 106 in a downward position when not engaged and assists in making slip segments 106 move synchronously. For instance, if the casing collar 108 is placed into the TDPS at an awkward angle, and that casing depresses only one slip segment, without a release weight, the casing can become entangled in the slip segments. The casing would then need to be removed from the tool and repositioned. The release weight 104 maintains the slip segments 106 in position relative to each other, such that if the casing 108 is moved into the TDPS at an awkward angle, any one slip segment 106 will maintain its position, thus forcing the casing collar 108 into the proper position with efficiency and ease. In one embodiment of the present invention, the dimensions of the release weight 104 are 7½ O.D. by 6½ long, weighing approximately 40 lbs.

The existing rotary table contains a previously existing casing within that rotary table. The new casing 109 is set to thread to the previous casing within the rotary table. The weight of the TDPS of the present invention is sufficient for the two casing pieces to be in contact.

When the existing top drive connected to the TDPS is actuated and the slips 106 of the TDPS are engaged as in FIG. 2, the turning sub 103 rotates, threading the casing 109 into the casing previously existing within the rotary table. Once threaded, the top drive and TDPS moves upward and the release weight pushes slip segments downward, by only the force of gravity, and away from pipe, and the casing collar 108 is released (see FIG. 1), allowing the casing 109 to move down within the earth and allow the process to begin again.

FIG. 2 shows a cross section view of the TDPS with the spinner engaged. This position is achieved where the top drive is connected to the TDPS and the top drive is pressing downward with its weight. In this position, note that the release weight 104 is in close proximity to the top plate 102, the slip segments 106 are in contact with the casing collar 108 and the fill tube and fluid release valve 107 extends into the casing 109.

Figure 3:
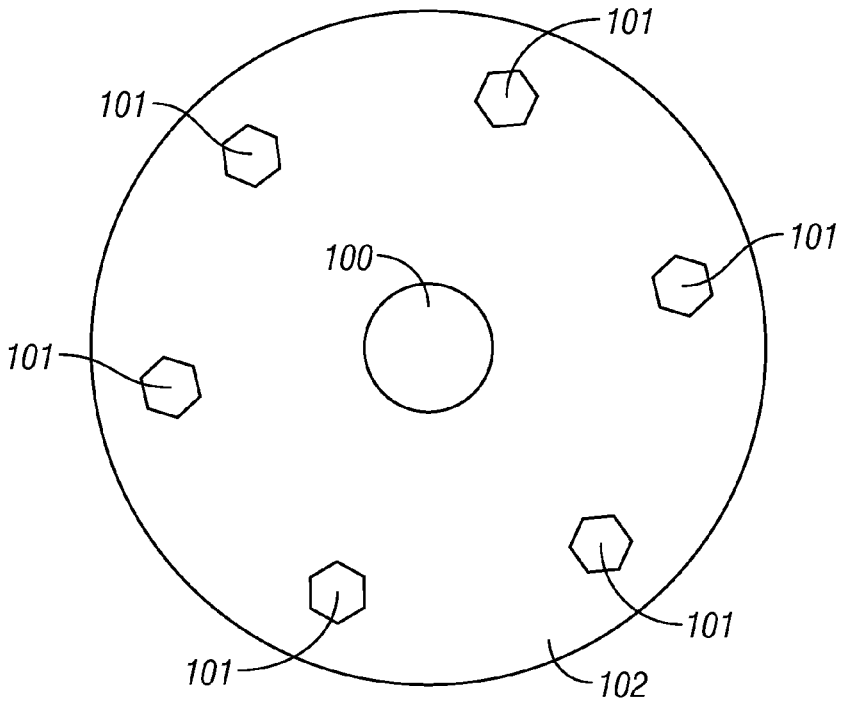
FIG. 3 is a top view of an embodiment of the TDPS of the present invention.

FIG. 3 shows a top view of the TDPS. The top drive connection 100 is a threaded pipe to be received by the user's existing top drive. As shown in FIG. 3, a plurality of bolts 101 are used to secure the top plate 102. In one preferred embodiment, approximately 6 bolts are used. As is well known, any different number of bolts may be sufficient to secure the top plate 102. Other fasteners are contemplated, as well as other means of coupling the top plate 102 to the turning sub 103. Note the top drive connection 100 can be made as one piece with the top plate 102 as shown in this illustration. Alternatively, the top drive connection 100 can be welded to the top plate 102. As is well known in the art, other methods of securing the top drive connection 100 to the top plate 102 are well known and are contemplated by the present invention. Moreover, it is contemplated that the top drive connection 100, top plate 102, can be made as one piece, as stated above.

Figure 4:
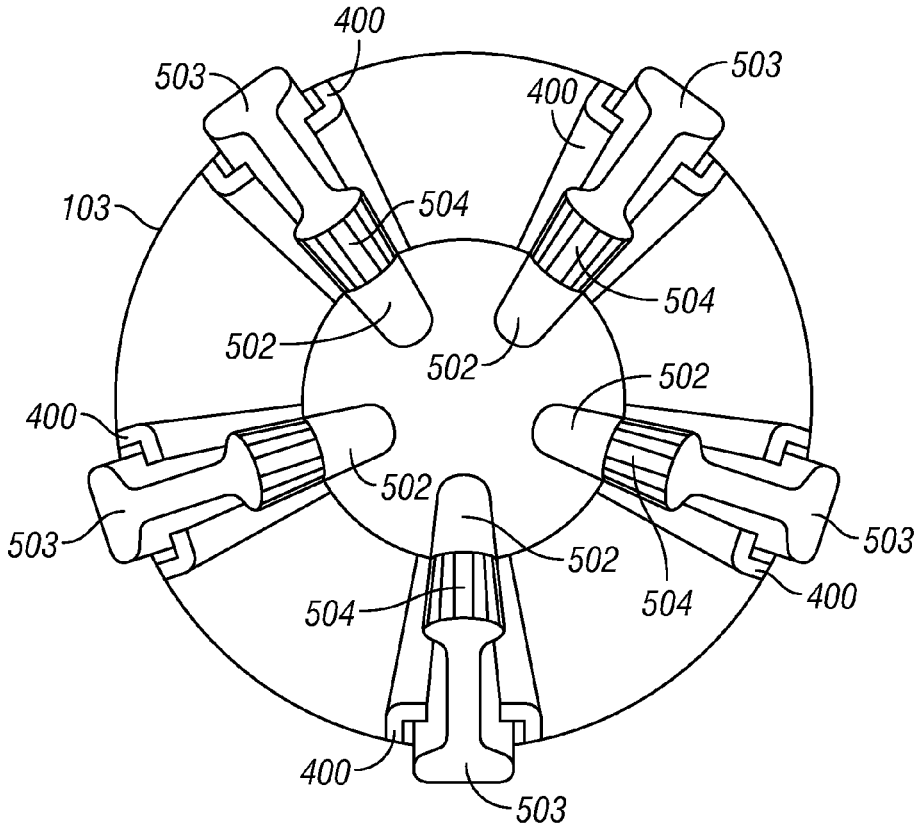
FIG. 4 is a bottom view of the TDPS of the present invention, as in one embodiment.

FIG. 4 shows a bottom view of the TDPS of the present invention. The outer periphery is the turning sub 103. The slip segments 106 are secured by T-slots 400 cut into the turning sub 103 (See FIGS. 1 and 2). The slip segments are cavity backed and form a T to be inserted into the T-slots 400 that have been cut into the turning sub 103. In the preferred embodiment, the T-slots 400 are constructed as part of the turning sub 103, thus lending to the integrity of the TDPS of the present invention. Alternatively, T-slots 400 can be welded onto the turning sub 103 using appropriate pieces such as angle irons and the like. The top plate 102 secures the top drive connection 100 to the turning sub 103. Also shown in FIG. 4 are the plurality of inverted slips 106. The slips 106 engage the casing collar 108 at the interior of the TDPS, and each of the T-slots 400 house one of the plurality of slips 106. FIG. 4 also illustrates the bottom portion of the fill tube with fluid release valve 107. The fill tube with fluid release valve 107 reside within the TDPS at its approximate center.

Figure 5:
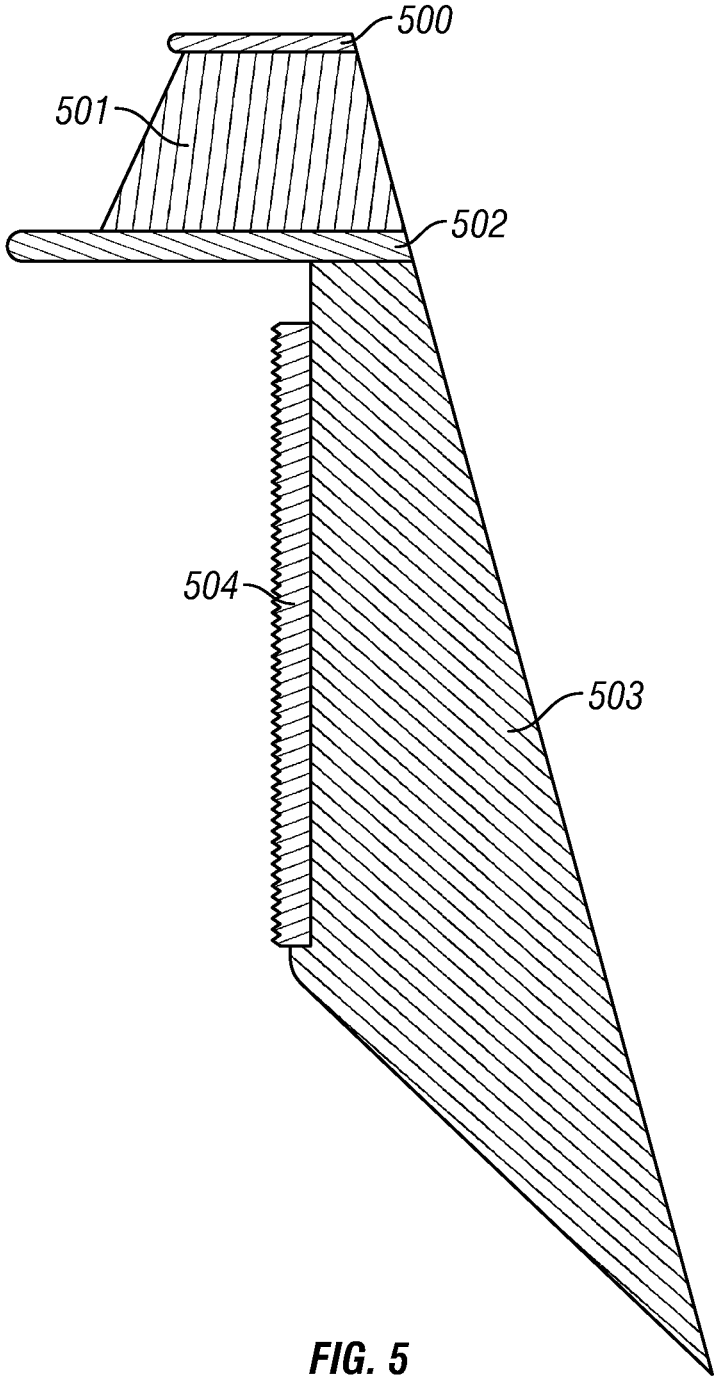
FIG. 5 is a view of the inverted slip of the TDPS, as in an embodiment of the present invention.

FIG. 5 shows an illustrative side view of one of the plurality of slips 106 used in the TDPS. In one preferred embodiment, approximately 5 slips 106 are used to create the TDPS. As is well known by those in the art, other numbers of slips, such as 3, 6, 7, 8 and more than 8 can be used to create the present invention. Slips are commonly used in the oil industry. Slips are commonly used to grip and hold the upper part of a drill string to the drill floor of an oilrig. The present invention repurposes these slips by inverting them so that they may efficiently run casing by inverting the slip.

The release weight 104 illustrated in FIGS. 1 and 2 contacts with the release weight plate 500 at the topmost portion of the slip (see FIG. 5). The release weight plate 500 contacts the engaging body 501 of the slip when in the exterior position. In the preferred embodiment, the slip body 501 is approximately 4 inches in length. Below the engaging body 501 is the engaging plate 502, which comes into contact with the casing collar 108 to engage the slips 106 as the casing 109 is received by the TDPS. When disengaged, the engaging plate 502 has an exterior position to the center of the TDPS. The casing collar 108 pushes upward on the engaging plate 502 causing the slips 106 to move upward and inward to grip the casing collar 108. In this engaged position, the engaging plate 502 moves toward the interior position (closer to the center of the TDPS). At all times the engaging plate 502 is substantially perpendicular to the turning sub 103. Additionally, note the dimensions of the slip will necessarily change if scaling the TDPS to suit larger casing, the present figures are for a 4" drill pipe, 4½", or 5½" casing collar.

Further shown in FIG. 5, the engaging plate 502 is connected to the slip body 503, which is substantially perpendicular to the turning sub 103 on the interior side, and angled outward from the interior on the opposite side, the slip body 503 resembling a shark-fin type shape. On the interior edge perpendicular to the engaging plate 502 of the slip body 503 is the slip deye 504. The slip deye 504 has a jagged interior-facing edge to grip the exterior of the casing collar 108 when the TDPS is engaged. The length of the slip deye 504 in the preferred embodiment, is approximately 4½ inches. The length of the slip body, in its entirety, is approximately 7 to 11 inches (wherein the slip body extends approximately 2 and ½ inches from the posterior end of the slip deye). The slip deye 504 is substantially parallel with the turning sub 103. In the preferred embodiment, the slip is constructed of a durable metal such as steel, other suitable alloys, or metallurgic materials.

When the slip is in the engaged position, the slip deye 504 is in an interior position, closer to the center of the TDPS. When the slip is disengaged, the slip deye 504 is in an exterior position, closer to the exterior of the TDPS. In the preferred embodiment, where the TDPS is running casing with a 5 and ½ inch collar, there is ¼ inch around the collar 108 where the TDPS is not engaged. The slips then move to contact the collar when the TDPS is engaged. This same TDPS that can run casing with a 5½ inch casing collar, can also be used for a 4 inch drill pipe or 4½ inch casing collar.

While the slip is well known, inverting the slip to be used in this manner is novel and unknown to those in the art. The slip deyes 504 of the present invention are durable, and capable of use for extended periods of time, up to 9 years of regular use. Alternatively, deyes 504 can be used to run at least approximately 300,000 ft of pipe before being replaced. When slip deyes 504 become dulled, new deyes may be replaced.

FIG. 6 illustrates the fill tube and fluid release valve 107 shown in FIGS. 1 and 2. The fill tube and fluid release valve has an uppermost threaded region 304 that secures the fill tube and fluid release valve to the top drive connection 100 and thus the TDPS. The fill tube 300 extends from the threaded region 304 down to the fluid release valve 303. The fluid release valve 303 is functionally comprised of a ball seat 301, ball check 305, and tension spring 302. The fluid release valve 303 allows for the controlled filling of casing while eliminating errant spills on the rig floor. When a predetermined pressure is reached by an existing mud pump (for instance 150 psi), the pressure overcomes the tension spring 302, which allows the ball check 305 to move away from the ball seat 301, allowing fluid to be pumped into casing 109 being joined to the previously existing casing within the rotary table. Once the predetermined amount of fluid is pumped into the casing 109 (see FIGS. 1 and 2) the pump is disengaged and when the pressure drops below the 150 psi, then ball check 305, move back up to seat 201 to the locked position as the tension spring 302 engages and flow of fluid is stopped. It is contemplated that rather than the ball seat and check system, a valve could be employed that is pressure dependent or manually operated to allow the filling of the casing in a controlled manner. Any such mechanized release system capable of responding to pressure would be appropriate for use in the TDPS of the present invention, as is known by those skilled in the art.

For example, where a 4½ inch casing holds 0.68 gallons per foot, to fill a 40 foot joint approximately 26 gallons of fluid would be dispensed through the fluid release valve. However, where a 5½ inch casing holds approximately 1 gallon per foot, a 40 foot joint would use approximately 40 gallons of fluid. Thus, the amount of fluid dispensed by the TDPS is dependent upon the size of the joint and the diameter of casing.

The dimensions provided above are for one preferred embodiment of the TDPS. Dependent on the size of casing to be run, dimensions of the TDPS will necessarily change. In the preferred embodiment described above, the TDPS can run 4 inch drill pipe, 4½ inch and 5½ inch casing. In this embodiment, the smallest tool joint measured on the drill pipe is approximately 4¾ inch, making the interior position approximately 4½ inches in diameter (the diameter of the circle formed by the plurality of slips). For the purposes of this example, note that the casing collar on a 4½ inch casing is approximately 5 inches in diameter; and where a 5½ inch casing is used, the casing collar is approximately 6 inches. Where a 5½ inch casing is used, the exterior position of the slips would be approximately 6½ inches. Also note, as stated above, to achieve a steeper bevel, the length of the bevel may be modified without modifying other parameters. Moreover, components of the TDPS will be made of a durable material such as steel, other alloys, metallurgic materials, iron, or the like.

It will be apparent to those skilled in the art that various modifications and variations can be made in the TDPS of the present invention without departing from the scope or spirit of the invention and that certain features of one embodiment may be used or interchangeably in other embodiments. Thus, it is intended that the present invention cover all possible combinations of the features shown in the different embodiments, as well as modifications and variations of this invention, provided they come within the scope of the claims and their equivalents. All measurements are approximate and the size of the insert will vary with the scale remaining close to the preferred embodiment described.

I claim:

1. A top drive pipe spinner comprising:

a top drive connection comprising a threaded interior that connects to a top drive;

a top plate connected to the top drive connection and a turning sub, the top plate being substantially the same shape as a cross section of the turning sub;

the turning sub having an interior with an inverted bevel in the bottom half of the turning sub, and having a plurality of t-slots each to receive an inverted slip at the bottom end of the turning sub;

a fill tube connecting to the top drive connection and extending through the center point of the turning sub, said fill tube terminating in a fluid release valve, said fluid release valve comprising a ball seat, a ball check, and a tension spring, and wherein the fill tube and fluid release valve receive fluid that may flow through the fill tube and out of the fluid release valve when activated;

a plurality of inverted slips, wherein each of the inverted slips are received by the t-slots and each of the inverted slips comprising a release weight plate that can be in contact with a release weight, a slip deye having a jagged edge and on the interior-facing side of the inverted slip, and a slip body extending from the slip deye and received by the t-slot; and the release weight residing within the interior and upper half of the turning sub, said release weight able to move upward and downward within the top drive pipe spinner and having an opening to receive the fill tube, and wherein when the release weight is in the uppermost position, and substantially in contact with the top plate and the plurality of inverted slips are in an interior position relative to the top drive pipe spinner, and wherein when the release weight is in the lowermost position, the plurality of inverted slips are in an exterior position and space exists between the top plate and release weight.

2. The top drive pipe spinner of claim 1, wherein five inverted slips are housed within the turning sub.

3. The top drive pipe spinner of claim 1, wherein a casing collar is placed in contact with at least one of the plurality of inverted slips with an upward force, toward the top drive, the casing collar in contact with an engaging plate and is gripped by the slip deye of at least one of the plurality of inverted slips, the release weight keeping the plurality of slips in position and the release weight moving upward toward the top plate, the top drive moving downward and securing the casing collar by the slip deyes moving to an interior position and being in contact with the exterior of the casing collar, the casing collar extending to a casing, said casing being received by a rotary table, wherein when the top drive spinner has engaged the casing collar, the casing is received by the rotary table and the top drive pipe spinner then moves in a circular motion, threading the casing to an existing pipe within the rotary table.

4. The top drive pipe spinner of claim 1, wherein when a pressure of approximately 150 psi is achieved within the fill tube, the tension spring is compressed, moving the ball seat and allowing fluid to flow therethrough.

5. The top drive pipe spinner of claim 1, wherein the angle of the inverted bevel relative to the exterior of the turning sub is between 10 and 25 degrees.

6. A top drive pipe spinner for engaging casing collar comprising:

a top drive connection comprising a threaded interior that connects to a top drive extending to a top plate connected to a turning sub, the top plate being substantially the same shape as a cross section of the turning sub and the top plate being secured to the turning sub with a plurality of bolts;

the turning sub having an interior with an inverted bevel and a plurality of t-slots in the bottom half of the turning sub, each of said t-slots to receive an inverted slip;

a fill tube connecting to the top drive connection and extending through the turning sub, said fill tube terminating in a mechanized release system, wherein the fill tube receives fluid that may flow through the mechanized release system when activated;

a plurality of inverted slips, wherein each of the inverted slips are received by the t-slots and each of the inverted slips comprising, a release weight plate that can contact with a release weight, a slip deye having a jagged edge and on the interior-facing side of the inverted slip, and the slip body extending from the slip deye and received by the t-slot;

the release weight residing within the interior and upper half of the turning sub, said release weight able to move upward and downward within the top drive pipe spinner and having an opening to receive the fill tube;

wherein a casing collar is placed in contact with the inverted slips with an upward force, toward the top drive, the casing collar is in contact with the engaging plate and gripped by the slip deye of at least one of the plurality inverted slips, the release weight keeping the plurality of slips in position and the release weight moving upward toward the top plate, the top drive moving downward, causing the slip deyes to move to an interior position toward the center of the top drive spinner, the plurality of slip deyes gripping the exterior of the casing collar and securing the casing collar; and wherein the top drive moves upward causing the release weight to move downward within the turning sub, causing the plurality of inverted slips to move toward the exterior of top drive pipe spinner and releasing the casing collar.

7. The top drive pipe spinner of claim 6, wherein five inverted slips are housed within the turning sub.

8. The top drive pipe spinner of claim 6, wherein when a pressure of approximately 150 psi is achieved within the fill tube, the mechanized release system is activated and allows fluid to flow through the fill tube.

9. The top drive pipe spinner of claim 6, wherein the angle of the inverted bevel relative to the exterior of the turning sub is between 10 and 25 degrees.

10. The top drive spinner of claim 6, wherein the mechanized release system is a fluid release valve comprising a ball seat, a ball check, and a tension spring.

11. A top drive pipe spinner for running casing comprising:

a top drive connection comprising a threaded interior that connects to a top drive and extending to a top plate connected a turning sub, the top plate being substantially the same shape as a cross section of the turning sub;

the turning sub having an interior with an inverted bevel with an angle of between 10 and 25 degrees, in the bottom half of the turning sub, and having a plurality oft-slots each to receive an inverted slip in the bottom half of the turning sub;

a fill tube connecting to the top drive connection and extending through the turning sub, said fill tube terminating in a mechanized release system, and wherein the fill tube receives fluid that may flow through the mechanized release system when activated;

a plurality of inverted slips, wherein each of the inverted slips are received by a t-slot and each of the inverted slips comprising, a release weight plate that can contact with a release weight, a slip deye having a jagged edge on the interior-facing side of the inverted slip, and a slip body extending from the slip deye and received by the t-slot;

the release weight residing within the interior and upper half of the turning sub, said release weight able to move upward and downward within the top drive pipe spinner and having an opening to receive the fill tube, wherein a casing collar is placed in contact with an inverted slip with an upward force, toward the top drive, the casing collar is gripped by the slip deye of the plurality of inverted slips, the release weight keeping the plurality of slips in position and the release weight moving upward toward the top plate, the top drive moving downward causing the plurality of slip deyes to move to an inward position, toward the center of the top drive pipe spinner, the plurality slip deyes gripping the exterior of the casing collar and securing the casing collar, the casing collar extending to a casing, said casing being received by a rotary table, wherein when the top drive spinner has engaged the casing collar, the casing is received by the rotary table and the top drive pipe spinner then moves in a circular motion, threading the casing to an existing pipe within the rotary table, and while the casing is threaded, the mechanized release system is activated and fluid flows from the fill tube into the casing; and wherein, after the casing is threaded, the top drive moves upward causing the release weight to move downward within the turning sub, causing the plurality of inverted slips to move to an exterior position toward the exterior of the top drive pipe spinner and release the casing collar.

12. The top drive pipe spinner of claim 11, wherein five inverted slips are housed within the turning sub.

13. The top drive pipe spinner of claim 11, wherein when a pressure of approximately 150 psi is achieved within the fill tube, the mechanized release system is activated allowing fluid to flow through the fill tube.

14. The top drive spinner of claim 11, wherein the mechanized release system is a fluid release valve comprising a ball seat, a ball check, and a tension spring.

* * * * *